United States Patent [19]

Phillips

[11] Patent Number: 4,573,238

[45] Date of Patent: Mar. 4, 1986

[54] DOOR CLOSER INCORPORATING SELF-CLEANING AND TEMPERATURE COMPENSATING FLOW CONTROL VALVE

[75] Inventor: Douglas C. Phillips, Wylde Green, England

[73] Assignee: Newman-Tonks Engineering Limited, Birmingham, England

[21] Appl. No.: 628,384

[22] Filed: Jul. 6, 1984

[30] Foreign Application Priority Data

Apr. 4, 1984 [GB] United Kingdom ..... 8408636

[51] Int. Cl.[4] ..... E05F 1/08

[52] U.S. Cl. ..... 16/79; 16/DIG. 21; 137/513.5; 251/82

[58] Field of Search ..... 16/49, 58, 62, 64, 69, 16/79, DIG. 9, DIG. 10, DIG. 21; 251/82; 137/513.5

[56] References Cited

U.S. PATENT DOCUMENTS

| | | | |
|---|---|---|---|
| 345,197 | 7/1886 | Wade | 251/82 |
| 362,166 | 5/1887 | Lieb | 251/82 |
| 862,614 | 8/1907 | Davey | 251/82 |
| 1,152,338 | 8/1915 | Norton | 16/62 |
| 3,420,493 | 1/1979 | Kraft | 251/82 |
| 4,073,033 | 2/1978 | Lexnas | 16/DIG. 9 X |
| 4,386,446 | 3/1981 | Zunkel et al. | 16/DIG. 21 X |

*Primary Examiner*—Fred Silverberg

*Attorney, Agent, or Firm*—Trexler, Bushnell & Wolters, Ltd.

[57] ABSTRACT

A door closer device comprises a body defining an internal chamber in which a piston is slidably received, the chamber, in use, containing hydraulic fluid. A valve is arranged in a passage in the body to permit the fluid to flow through the passage in both directions between spaces in the chamber at respective opposite sides of the piston. The valve has a first part axially adjustable along the passage and a valve member attached to said first part but movable axially relative thereto in the passage between extreme positions where it engages respective stop means on the first member, the valve member allowing fluid to flow unrestricted through an orifice at one end of the passage in one direction when in one of its said extreme positions, and at the other extreme position restricting flow through said orifice in the opposite direction. Preferably the valve member is made of a material having a greater co-efficient of expansion than the material of the body containing said passage, so that expansion or contraction of the valve member with temperature changes enables a more constant door closing speed to be obtained by increasing or decreasing the size of the orifice as the viscosity of the hydraulic fluid also changes with temperature changes.

6 Claims, 1 Drawing Figure

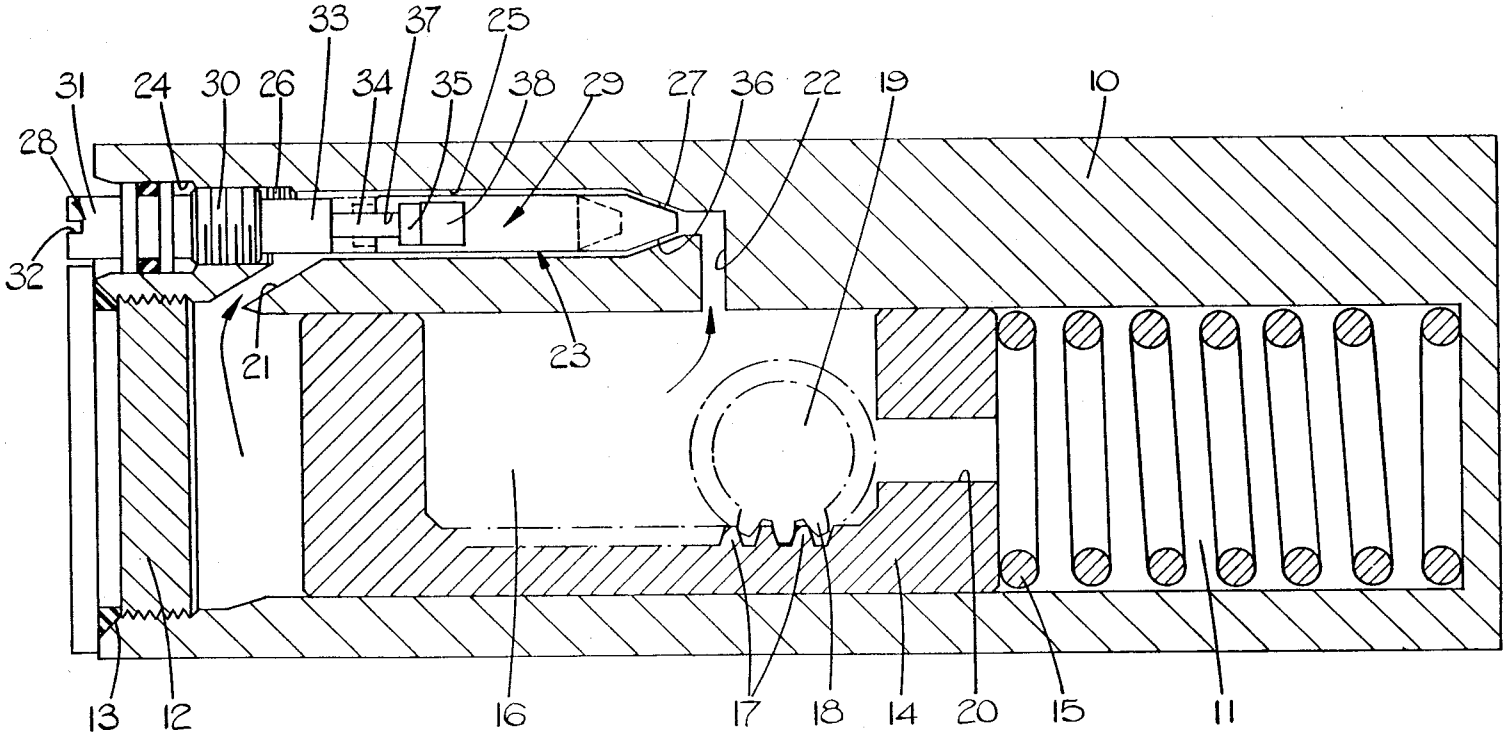
10
11
15
20
14
19
18
22
17
36
27
29
23
38
25
16
35
37
34
33
26
21
30
24
12
13
31
28
32

DOOR CLOSER INCORPORATING SELF-CLEANING AND TEMPERATURE COMPENSATING FLOW CONTROL VALVE

This invention relates to a flow control valve for controlling the flow of liquid through a bore or opening and is particularly concerned with a door closer incorporating such a valve.

With conventional door closers, the closing time of the door to which the closer is attached increases with use as foregin particles in suspension in the hydraulic fluid in the door closer collect in, and eventually substantially block the orifice through which restricted flow is intended to take place, this orifice usually containing a tapered needle or equivalent part.

An object of the invention is to provide a flow control valve, particularly suitable for this and analogous purposes, which reduces the risk of incorrect function due to the build up of foreign particles and which is moreover effective in normal use.

According to the invention there is provided a flow control valve comprising a first member adapted for axial adjustment in a bore in a body in which it is to be used, the first member providing two stop means, a valve member connected to said first member, but movable axially relative thereto in said bore, in use, between spaced axial positions where it engages said two stop means respectively, the valve member having a taper at one of its ends which is complementary to a tapered portion of said bore, the arrangement being such that for a given axial position of the first member, one of said axial positions of the valve member minimises separation of the respective tapers of the valve member and the bore, whilst said other axial position maximises said separation.

According to a further aspect of the invention there is provided a door closer including a body defining an internal chamber, a piston slidably received in said chamber, the chamber, in use, containing hydraulic fluid, and a valve arranged in a passage in the body to permit flow of fluid through the passage in both directions between spaces within the chamber at respective opposite sides of at least part of the piston, the valve comprising a first member axially adjustably mounted in the passage and a valve member connected to said first member, but movable axially relative thereto in the passage between spaced axial positions where it engages respective stop means on the first member, so that at one of said axial positions the valve member allows fluid to flow unrestricted through an orifice in one direction, and at the other of said axial positions it restricts fluid flowing through said orifice in the opposite direction.

Preferably the valve member is made of a material having a higher coefficient of expansion than the material of the body containing the bore in which the valve member is disposed. The valve member thus expands or contracts in direct relationship to temperature and thereby adjusts the size of the hydraulic fluid flow orifice. The orifice widens as the temperature drops, the hydraulic fluid, usually oil, thickens and the valve member contracts. As the temperature rises the converse occurs. Thus a more constant door closing speed can be obtained.

The invention will now be described, by way of example, with reference to the accompanying drawing, the single FIGURE of which is a section in plan of a door closer incorporating a flow control valve, constructed in accordance with the invention.

The drawing shows a door closer device having a body 10 defining cylindrical chamber 11 therein. The chamber 11 is closed at one of its ends and its opposite, open end is closed, in use, by a plug 12 with associated sealing ring 13. Within the chamber 11 is a position 14 which is biased towards the end of the chamber closed by the plug 12 by a spring 15 between the piston and the closed end of the chamber opposite the plug 12. The piston has a central cavity 16 which along one wall is provided with rack teeth 17. Engaged with the teeth 17 are complementary teeth 18 of a pinion 19 which extends out of the body 10 in the normal manner for connection to an arm or a system of levers attached, in use, either to a door or its frame so that opening and closing movement of the door is accompanied by axial movement of the piston 14 within the cylindrical chamber 11. Since this arrangement is of conventional form, it will be not described further. The cylindrical chamber is filled with hydraulic fluid, such as oil, which occupies the spaces at both sides of the piston 14 and also the cavity 16 within the piston. A bore 20 allows communication between the cavity 16 and the side of the piston at which the spring 15 is disposed.

The travel of the piston 14 within the chamber 11 is relatively short and is between two drillings 21, 22 respectively in the body 10 which open into the chamber 11. The drilling 21 communicates with the space at the side of the piston adjacent the plug 12, whilst the drilling 22 communicates with the cavity 16 within the piston. In the specific example illustrated, the drilling 21 is at an acute angle to the axis of the chamber 11, whilst the drilling 22 has a first portion at 90° to said chamber axis and a shorter second portion parallel to said axis. Interconnecting the drillings 21, 22 is a bore 23 extending parallel with the axis of the chamber 11. The drillings 21, 22 and bore 23 can be disposed in the body in any suitable alternative orientation. The bore 23 has a first portion 24 extending inwardly into the body from an end face thereof. At the end of the first portion 24, the bore 23 is stepped inwardly to provide a second portion 25 which extends for almost the whole of the remainder of the bore. Part of the second portion 25 adjacent the step is threaded as indicated at 26, and at the position where this threaded part terminates, the drilling 21 communicates with this second portion 25 of the bore 23. The end of the bore 23 is in the form of a tapered part 27 leading from the second portion 25, and the smaller end of this tapered part 27 communicates with the part of the drilling 22 which extends parallel to the axis of the chamber 11, so that hydraulic fluid can flow in both directions within the bore 23 by way of the drillings 21 and 22.

Contained within the bore 23 is a flow control valve for controlling flow of hydraulic fluid through said bore. The flow control valve is formed in two parts, namely a first part 28 which is threadedly engaged in the bore 23, and a movable valve member part 29.

The first part 28 has a central portion 30 which is externally threaded to engage with the threaded part 26 of the second portion 25 of the bore 23. The central portion 30 is shorter than the length of the threads 26. Extending from one side of the portion 30 is an adjustment part 31. This extends through the first portion 24 of the bore 23 so that its end projects outwardly thereof, this end being formed with a screwdriver slot 32. Along its length the part 31 is formed with a pair of spaced flanges between which is disposed a sealing ring. Flanges and sealing ring engage the internal surface of the first portion 24 of the bore 23 thereby forming a seal.

Extending from the opposite side of the central portion 30 is a smaller diameter cylindrical part 33 and extending from the end of this part 33 is a cylindrical rod 34 of still smaller diameter. Finally at the end of the rod there is a short cylindrical head 35 of a diameter between those of the rod 34 and part 33. By way of the slot 32 it is possible to rotate this first part of the flow control valve so as to move it axially into or out of the bore 23 by way of the threaded engagement between the central portion 30 and the threads 26. The valve member part 29 is of generally cylindrical form but has a tapered end surface 36 of substantially the same form as the tapered part 27 of the bore 23. The external diameter of the cylindrical part of the valve member part 29 is less than the diameter of the second portion of the bore 25. Thus an annular gap is formed around the valve member part 29 within the second portion 25 of the bore 23.

At its other end, the valve member part 29 is provided with a cylindrical opening 37 leading into an enlarged recess 38. The opening 37 is designed to receive the rod 34 whilst the recess 38 is dimensioned to receive the head 35. As will be explained the valve member part 29 is desirably made of plastics material and this allows the head 35 to be snap-fitted in the recess 38 with the rod 34 engaging in the opening 37, thereby connecting the movable valve member part 29 to the first part 28 of the flow control valve which is fixed at a chosen axially adjusted position within the bore 23. The first part 28 is screwed into the bore 23 until a chosen axial position is reached. This position is chosen so that with the valve member part 29 in the position shown in the drawing its tapered end surface 36 is slightly spaced from the complementarily tapered part 27 of the bore 23 so that there is at least a small gap between said tapered parts. The respective lengths of the rod 34, head 35, opening 37 and recess 38 are chosen so that the valve member part 29 can move from the position shown in full in the drawing to the position shown in dashed lines, where the tapered end surface 36 has moved clear of the tapered part 27 of the bore 23. Similarly the end of the valve member part 29 having the opening 37 therein will have slid along the rod 34 until it abuts against the surface of the part 33 from which the rod extends. In this position the head 35 will normally still be spaced from the closed end of the recess 38, though it could be arranged that the head would abut this closed end of the recess as well as or in place of the abutment of the valve member part against the part 33.

In operation, this flow control valve permits free flow of hydraulic fluid as the door is being opened and restricts such flow in the reverse direction at a preselected rate, thus controlling the door closing speed.

In the position shown in the drawing, the door would be closed and the pinion teeth 18 are at one extreme end of the rack teeth 17. On opening the door, the pinion 19 would be caused to rotate in an anti-clockwise direction, as viewed in the drawing, so that the rack, and thus the piston 14 would be moved to the right against the force of the spring 15. Hydraulic fluid in the cavity 16 would thus be forced through the drilling 22. This free flow of hydraulic fluid created by movement of the piston causes the valve member part 29 to move against said cylindrical part 33. The gap between the tapered part 27 and the tapered end surface 36 is thus increased to allow the fluid to flow freely in the annular gap around the valve member part 29 and thereafter through the drilling 21 into the space between the piston and the plug 12.

Once the force applied to open the door is removed, the door commences to close by virtue of the biassing force of the spring 11 forcing the piston 14 to the left as shown in the drawing. This movement of the piston causes rotation of the pinion 19 in the clockwise direction and hydraulic fluid is this forced out of said space between the piston and the plug and into the drilling 21. This flow of fluid causes the valve member part 29 now to move in the opposite direction towards the mating taper 27 of the bore 23 and to engage the head 35 at the end of the rod 34. Thus the cylindrical part 33 forms a stop in one direction of flow and the head 35 forms a stop in the opposite direction of flow. Thus the position shown in the drawing is then reached so that a restriction is formed between the two tapered surfaces at the end of the bore 23. Accordingly the flow of liquid back into the cavity 16 is restricted so that the speed of door closing is controlled.

The floating action of the valve member part 29, which occurs each time the door is opened, assists in the dispersion of fine debris which would normally congregate in the gap between the two tapers and thus uncontrollably further restrict the flow of the oil back into the chamber 16. Accordingly with this floating action of the part 29, the selected closing speed of the door is maintained more constant.

Adjustment or selection of the closing speed is achieved by moving the adjustment part 31 inwards or outward relative to the body by means of the threaded part 33. Thus this first part 28 of the flow control valve acts as a regulator. This movement of the first part 28 positions the head 35 and therefore varies the gap between the mating tapers. As will be appreciated the position shown in the drawing is substantially the furthest inward position of the part 28 since any further inward movement thereof would cause the respective tapered surfaces to engage and thus close the end of the bore 23.

The body 10 would normally be made of metal, for example aluminium, whilst, as mentioned, the part 29 would normally be made of plastics material with a higher coefficient of expansion than the material of the body. Accordingly a change in ambient temperature automatically causes expansion or contraction of the part 29 with a subsequent increase or decrease in the gap between the mating tapered surfaces, which compensates for the change in viscosity of the hydraulic fluid. Thus, for example, a fall in temperature would cause the hydraulic fluid to thicken. The thicker the fluid, the slower it would flow inside the closer and the slower the door would close. If however the fall in temperature is accompanied by a corresponding contraction of the part 29, the gap between the mating surfaces 27 and 36 would increase so that the door closing speed would remain more constant. The converse is equally true. Additionally the first part 28 of the flow control valve could also be of plastics material with consequential contraction or expansion thereof with a change in ambient temperature. In fact it would be possible for the first part 28 to be made of plastics material and the part 29 of metal since contraction or expansion of the rod 34 and head 35 would serve to axially move the part 29 so as to increase or decrease the gap between the mating tapers as appropriate. The head 35 would be deformable to snap fit it into the recess 38.

Thus a door closer is described which, with a simple arrangement of a bore and drillings enables a more constant door closing speed to be obtained by virtue of the self cleaning action incorporated into the flow control valve. Moreover the valve is easily and effectively adjustable for a chosen door closing speed, and finally it is also disclosed how, in a convenient and effective manner, the valve can be adapted, by the use of a suitable material, to compensate for temperature changes so as to maintain said constant door closing speed.

I claim:

1. A door closer including a body, a chamber defined within said body, said chamber being intended to receive hydraulic fluid, in use, a piston slidably received within said chamber, a passage in said body through which said hydraulic fluid is intended to flow in both directions between opposite sides of at least part of the piston, a valve fitted in said passage to control the flow and comprising a first valve member and a second valve member, two abutment surfaces on the first valve member, means on the first valve member engaging it with the body and permitting the first valve member to be axially moved in the passage to a selected position, the second valve member being connected to the first valve member, one end of the second valve member being tapered, one end of the passage having a taper complementary to the taper of said one end of the second valve member, the second valve member being freely axially movable in the passage relative to the first valve member, solely by flow of fluid through the passage, between extreme positions where it engages said two abutment surfaces respectively, one of said extreme positions allowing unrestricted flow in one direction through said passage from said tapered end of the passage and the other extreme position allowing restricted flow in the opposite direction, at least one of the first and second valve members being made of plastics material having a greater coefficient of thermal expansion than the material of the body containing the passage in which the valve is fitted so that changes in the ambient temperature affect the clearance between the second valve member and the tapered end of the passage.

2. A door closer in accordance with claim 1, wherein the first valve member has a neck part, an enlarged head at one end of the neck part, a larger main part at the other end of the neck part, the second valve member having a cylindrical external surface, except at said tapered end, a recess receiving said head, an opening into the recess through which the neck part passes, the second valve member being slidable on the neck part between said one extreme position where the valve member engages said main part and the other extreme position where it engages the head, said passage being linear and fluid flowing, in use, along said linear passage over the whole length of said second valve member.

3. A door closer in accordance with claim 1, wherein the first valve member has a neck part, an enlarged head at one end of the neck part, a larger main part at the other end of the neck part, the second valve member having a cylindrical external surface, except at said tapered end, a recess receiving said head, an opening into the recess through which the neck part passes, the second valve member being slidable on the neck part between said one extreme position where a surface of the head engages one end of the recess and the other extreme position where an opposite side of the head engages an opposite end of the recess, said passage being linear and fluid flowing, in use, along said linear passage over the whole length of said second valve member.

4. A door closer in accordance with claim 2 or claim 3, wherein said head is engaged in said recess as a snap-fit.

5. A door closer in accordance with claim 1, wherein the first and second valve members are snap-fitted together.

6. A door closer in accordance with any one of claims 1 to 5, wherein said piston has a cavity therein between opposite ends thereof, a bore communicating said cavity with the chamber at one end of the piston, the cavity being in permanent communication with said tapered end of the passage, a pinion within said cavity, a wall of said cavity having a rack thereon, the pinion engaging said rack to convert rotary movement of the pinion to linear movement of the piston thereby to cause flow of fluid through said passage.

* * * * *